US005375444A

United States Patent [19]

Smith

[11] Patent Number: 5,375,444

[45] Date of Patent: Dec. 27, 1994

[54] MULTI-KEY CORE LOCK ASSEMBLY

[75] Inventor: Jerry R. Smith, Littleton, Colo.

[73] Assignee: Shield Security Systems, Inc., Englewood, Colo.

[21] Appl. No.: 703,478

[22] Filed: May 20, 1991

[51] Int. Cl.[5] ..... E05B 27/04

[52] U.S. Cl. ..... 70/495; 70/337; 70/369; 70/493; 70/DIG. 30

[58] Field of Search ..... 70/493, 494, 495, 496, 70/337, 367–369, DIG. 30

[56] References Cited

U.S. PATENT DOCUMENTS

| | | | |
|---|---|---|---|
| 1,979,938 | 11/1934 | Jacobi | 70/369 |
| 2,070,233 | 2/1937 | Liss | 70/495 |
| 2,629,247 | 2/1953 | Deutsch | 70/495 X |
| 3,660,999 | 5/1972 | Janzen | 70/276 |
| 3,722,240 | 3/1973 | Spain et al. | 70/378 X |
| 3,733,863 | 5/1973 | Toepfer | 70/496 |
| 4,302,957 | 12/1981 | Wolter | 70/337 |
| 4,320,639 | 3/1982 | Kleefeldt et al. | 70/337 X |
| 4,376,382 | 3/1983 | Raymond et al. | 70/495 X |
| 4,478,061 | 10/1984 | Preddey | 70/495 X |
| 4,712,399 | 12/1987 | Mattossovich | 70/495 |
| 4,712,400 | 12/1987 | Steinbach | 70/369 |
| 4,789,859 | 12/1988 | Clarkson et al. | 70/278 X |
| 5,209,087 | 5/1993 | Cox | 70/369 |

FOREIGN PATENT DOCUMENTS

| | | | |
|---|---|---|---|
| 1021588 | 11/1977 | Canada | 70/495 |
| 3028474 | 2/1991 | Japan | 70/DIG. 30 |
| 2055948 | 3/1981 | United Kingdom | 70/495 |

*Primary Examiner*—Lloyd A. Gall
*Attorney, Agent, or Firm*—John E. Reilly

[57] ABSTRACT

A core lock assembly which is operable by two differently bitted keys is disclosed. The core lock assembly includes a shell defining a hollow portion for receiving a core which is capable of rotating to a first position under the control of a first key and to a second position under the control of a second, differently bitted key. The core lock assembly also includes a core rotation mechanism housed in the core for changing from a locked state to a first core rotatable state when the core rotation mechanism is engaged by the first key and for changing from the locked state to a second core rotatable state when the core rotation mechanism is engaged by the second key. The inner surface of the shell defines locking, first and second surface areas for cooperating with the core rotation mechanism. The locking surface area cooperates with the core rotation mechanism to enable a key engaging the core rotation mechanism to be removed from the core, the removal of which returns the core rotation mechanism to its locked state. The first surface area cooperates with the core rotation mechanism to permit the core to be rotated to the first position under the control of the first key. The second surface area cooperates with the core rotation mechanism to permit the core to be rotated to the second position under the control of the second key.

17 Claims, 5 Drawing Sheets

Fig_1
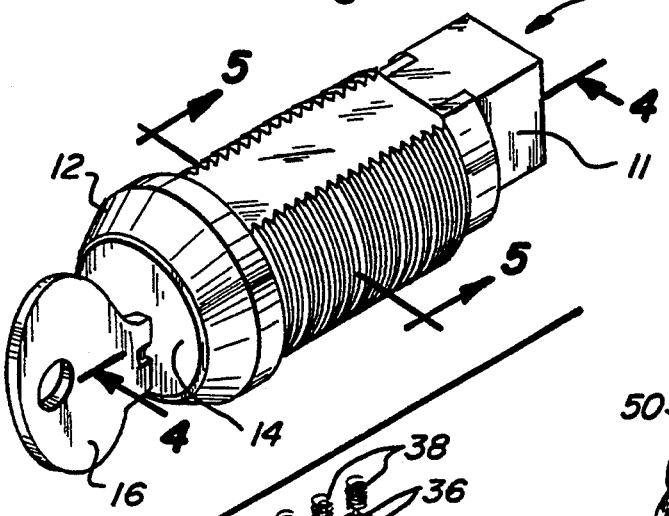
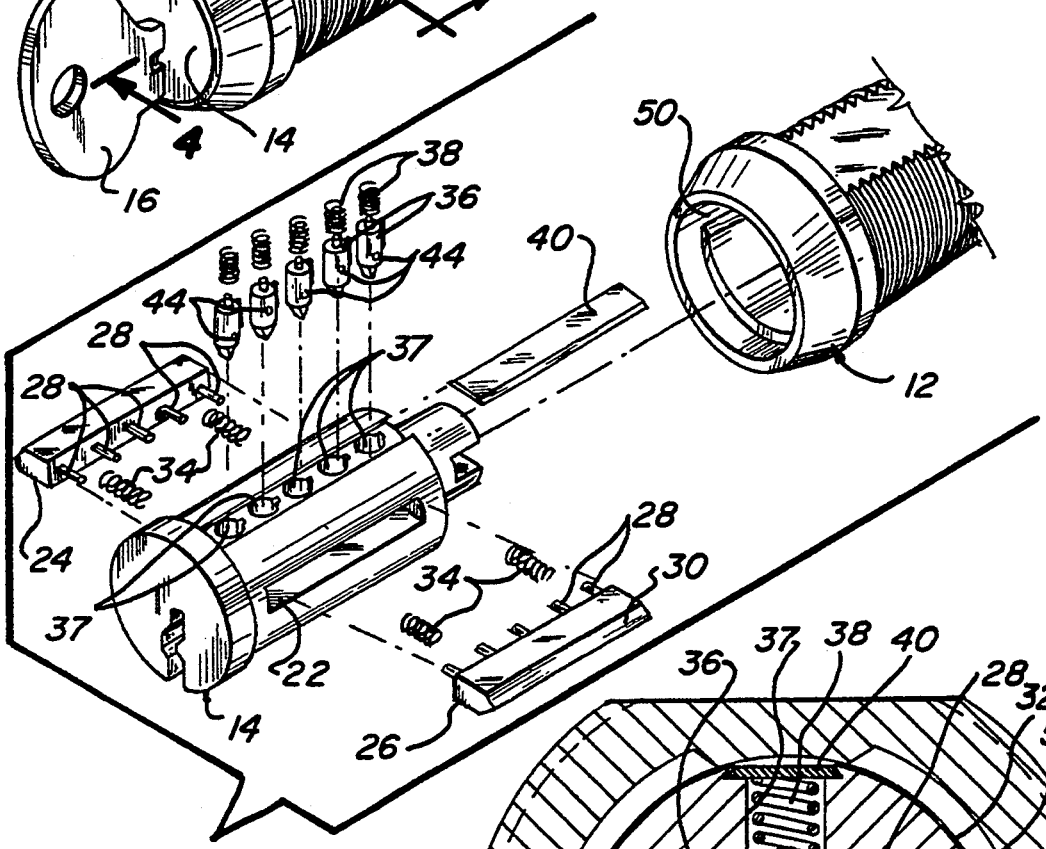
Fig_2
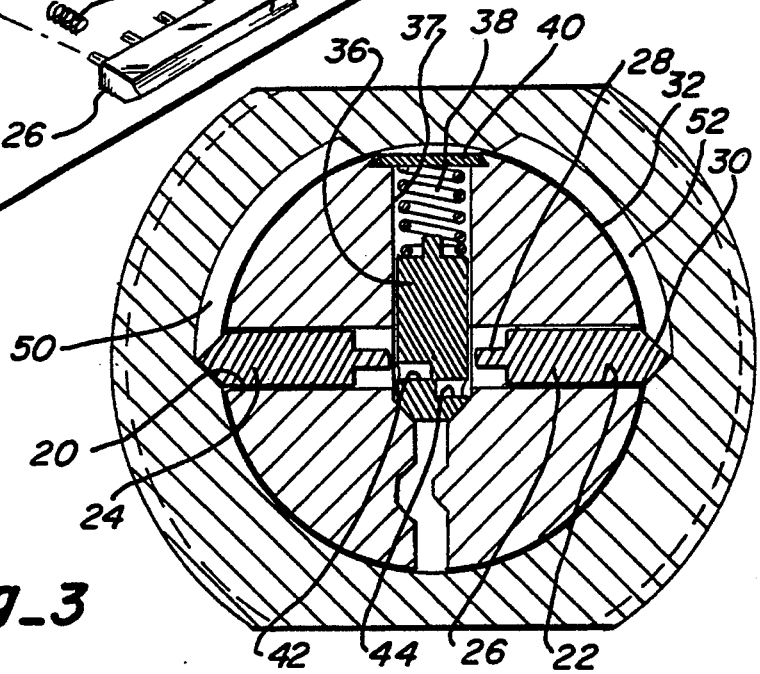
Fig_3

MULTI-KEY CORE LOCK ASSEMBLY

FIELD OF THE INVENTION

The invention relates generally to cylinder locks (referred to herein as core locks) which are operable by two keys and, more particularly, to core locks operated by two or more differently bitted keys, one of which may be used to remove the core from its shell.

BACKGROUND OF THE INVENTION

The ability to remove the core of core locks is desirable in that it allows a lock to be changed by merely removing the lock's core and replacing it with another core operable by another key. U.S. Pat. No. 4,866,964 to Hall which issued Sep. 19, 1989 discloses a removable core cylinder lock which is normally operated by an operation key but is also capable of having its core removed by a second control key. The lock has a spring clip carried by its shell which cooperates with a groove in the core for normally retaining the core within the shell. The spring clip can be moved, however, to enable core removal by a control key. The control key has the same bitting as the general operation key. However, it is slightly longer so that it raises the spring clip out of the groove to allow the core to be removed from the shell as the core is rotated by turning the control key.

While the core lock assembly disclosed in U.S. Pat. No. 4,866,964 enables the core to be removed from the shell, the control key has the same bitting as the normal operation key. Accordingly, each lock has a control key as well as a normal operation key. This creates a situation which is clearly undesirable for owners of large numbers of such core locks since it forces the owners to not only keep an inventory of operation keys, but also an inventory of control keys.

Accordingly, an object of the present invention is to provide a core lock system, the locks of which can have their cores removed with a single control key.

Another object of the present invention is to provide a core lock assembly which is capable of being operated by at least two differently bitted keys to perform at least two different functions.

DISCLOSURE OF THE INVENTION

In accordance with the aforementioned objectives, the present invention provides a core lock assembly which is operable by two differently bitted keys, one of which may be used to remove the lock's core from its shell. The core lock assembly includes a shell having an inner surface defining a hollow portion and a core received in the shell's hollow portion for rotating to a first operational position under the control of a first key and to a second operational position under the control of a second, differently bitted key. The core lock assembly also includes core rotation means (or a core rotation mechanism) housed in the core for changing from a locked state to a first core rotatable state when the core rotation means is engaged by the first key and for changing from the locked state to a second core rotatable state when the core rotation means is engaged by the second key. The inner surface of the shell also defines locking, first and second surface means or areas for respectively cooperating with the core rotation means. The locking surface means cooperates with the core rotation means to enable a key engaging the core rotation means to be removed from the core, the removal of which returns the core rotation means to its locked state. The first surface means cooperates with the core rotation means when it is in its first rotational state to permit the core to be rotated to the first operational position when the first key is turned. The second surface means cooperates with the core rotation means in its second rotational state to permit the core to be rotated to the second operational position when the second key is turned.

In a preferred embodiment of the invention, the core rotation means includes first and second shell engaging portions (preferably side bars) which move between extended and retracted positions. A first or second portion is in an extended position when its end extends beyond the perimeter of the lock's core. A first or second portion is in a retracted position when its end is located within the core's perimeter. The first portion is moveable to its retracted position when the core rotation means is engaged by the first key. When so engaged, the core is capable of being rotated from its locked position to its first operational position by turning the first key. Similarly, the second portion is moveable to its retracted position when the core rotation means is engaged by the second key which, in turn, enables the core to be rotated from its locked position to the second operational position. In this embodiment, the first surface means defines a first relief area which is sized, configured, and located to receive and permit limited rotational movement of the second portion's outer end (which is in an unretractable extended position) so that the core can be rotated to the first operational position by turning the first key. Similarly, the second surface means defines a second relief area which is sized, configured, and located to receive and permit limited rotational movement of the first portion's outer end (which is in an unretractable extended position) so that the core can be rotated to the second operational position point by turning the second key. The locking surface means is defined by side walls of the first and second relief areas which are sized, configured and located to prevent rotational movement of the outer ends of both the first and second portions when the ends are in unretractable extended positions which occurs when the core rotation means is in its locked state (which is the state the core is in when it is not engaged by a properly bitted key).

The aforementioned preferred embodiment of the invention also preferably includes means for removing the core from its shell. The preferred core removal means includes retainer means received in a slot provided in the shell. The retainer means has an inner facing projection which projects inwardly into the shell's hollow portion. The core is further provided with a groove in its outer surface. The groove receives the inner facing projection of the retainer means under normal operating conditions to prevent axial movement of the core within the shell, thereby preventing the core from being removed from the shell. To remove the core, the core removal means further includes a cut-out portion on the core which extends from the bottom of the groove to the core's rear end. The cut-out portion is sized, configured and located to receive and permit passage of the inner facing projection of the retainer means when the core is rotated to one of its operational positions by turning the proper key and then pulled axially to remove the core from the shell.

Another preferred embodiment of the present invention has core rotation means which may only have one movable shell engaging portion (preferably a side bar). The shell engaging portion is capable of moving inwardly towards the core's longitudinal axis from an extended position to at least a partially retracted position. The shell engaging portion is defined as being in an extended or partially retracted position when the shell engaging portion's outer end extends beyond the perimeter of the core. The shell engaging portion is defined as being fully retracted when substantially all of the shell engaging portion is located within the core's perimeter.

The core rotation means of this embodiment further includes first retraction means (preferably pin tumblers) for enabling the shell engaging portion to partially retract into the core from the extended position to a first position, i.e. when the core rotation means is engaged by the first key which changes the core rotation means from its locked state to its first core rotational state. As previously mentioned, in this state the core can be rotated to the first operational position by turning the first key. The core rotation means also defines second retraction means for enabling the shell engaging portion to fully (or partially retract) into the core from the extended position to a second position when the core rotation means is engaged by the second key. This changes the core rotation means to its second core rotational state which enables the core to be rotated to the second operational position by turning the second key.

The locking surface means of this embodiment defines a groove for receiving the outer end of the shell engaging portion in its extended position to enable a key engaging the core rotation means to be removed from the core, the removal of which returns the core rotation means to its locked state, i.e. its unretractable state. The first surface means defines a first area on the inner surface of the shell which is sized, configured, and located to cooperate with the outer end of the shell engaging portion in its partially retracted first position to permit limited rotational movement of the shell engaging portion so that the core can be rotated to the first operational position by turning the first key. The second surface means defines a second area on the inner surface of the shell which cooperates with the outer end of the shell engaging portion in its second position to permit rotational movement of the shell engaging portion so that the core can be rotated to the second operational position by turning the second key.

Additional advantages of this invention will become apparent from the description which follows, taken in conjunction with the accompanying drawings.

BRIEF DESCRIPTION OF THE DRAWINGS

FIG. 1 is a perspective view of a first embodiment of a core lock assembly of the present invention showing the core lock assembly engaged by a properly bitted key.

FIG. 2 is an exploded perspective view of the core lock assembly illustrated in FIG. 1.

FIG. 3 is a cross sectional view of the core lock assembly taken along lines 5—5 of FIG. 1 which illustrates the core lock assembly as it would appear when the key of FIG. 1 is removed from the core lock's key hole.

DETAILED DESCRIPTION OF PREFERRED EMBODIMENTS

Figure 4:
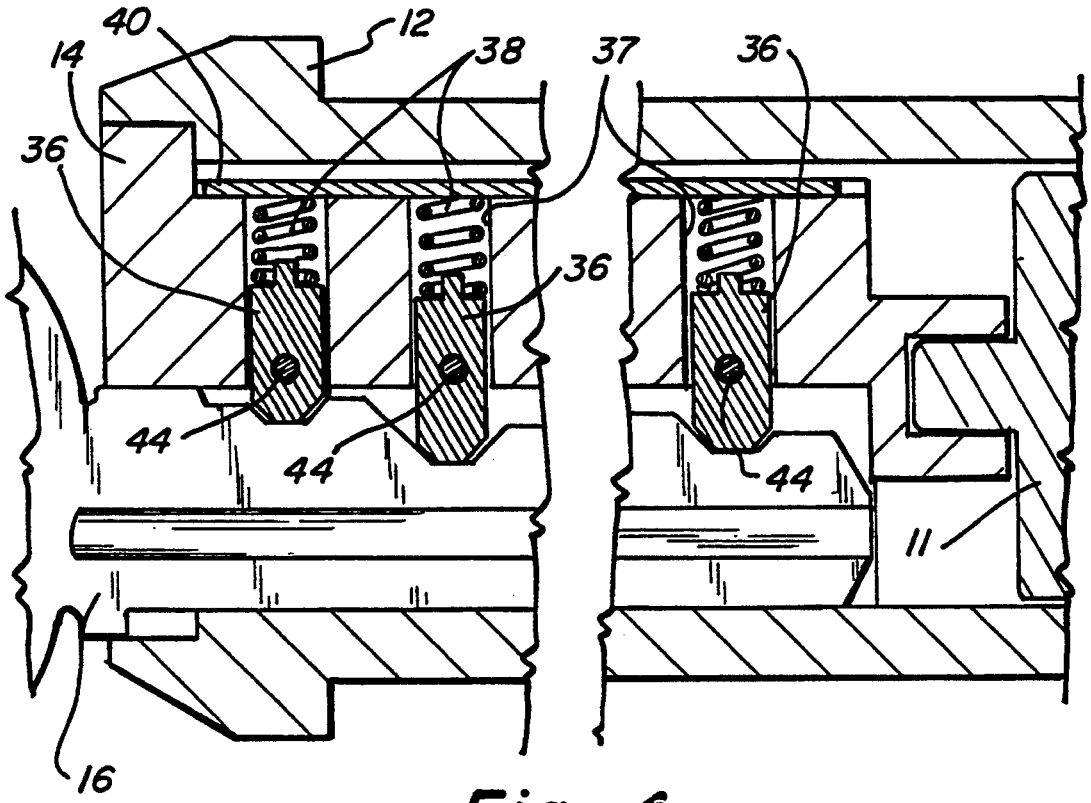
FIG. 4 is a cross sectional view taken along lines 4—4 of FIG. 1.

FIGS. 1–7 illustrate a first embodiment of the present invention which is a core lock assembly 10 of the type generally referred to in the industry as a "switch lock". While a switch lock is shown, the present invention is equally applicable to "cam locks" of the type shown in U.S. Pat. No. 3,722,240.

As best illustrated in the exploded view of FIG. 2, core lock assembly 10 includes a hollow shell 12 and a rotatable core 14 which is received in the shell's hollow portion. In accordance with an important aspect of the present invention, the core is capable of being rotated from its locked position illustrated in FIG. 3 to a first operational position illustrated in FIG. 6 when the core is engaged by a first properly bitted key 16. The core is also capable of rotating from the locked position to a second operational position illustrated in FIG. 7 when it is engaged by a second differently bitted key 18.

As illustrated in FIGS. 2 and 3, core 14 defines a pair of side bar slots 20 and 22 which are located on opposite sides of the core for receiving side bars 24 and 26, respectively. Each side bar is provided with retraction pins 28 which enable the side bars, as explained below, to move between unretracted, i.e. extended and retracted positions. As used herein, a side bar is in an extended position when its outer end 30 extends beyond the perimeter (which is identified by numeral 32) of the core. A side bar is defined herein as being in a retracted position when substantially all of the side bar, including its end 30, is located within the core's perimeter 32. As best illustrated in FIG. 2, side bars 24 and 26 are biased outwardly away from the core's longitudinal axis by springs 34.

Core 14 is also provided with a plurality of tumblers 36 which are biased by tumbler springs 38 which, in turn, are retained by retainer 40 as is known in the art. A good description of conventional tumblers, or pin tumblers as they are also called, is disclosed in U.S. Pat. No. 3,722,240.

Pin tumblers 36 are operable by differently bitted keys 16 and 18. The pin tumblers are capable of such operation since they are provided with two sets 42 and 44 of holes for receiving the retraction pins 28 of side bars 24 and 26. The first set 42 of holes receives the retraction pins of side bar 24 while the second set 44 of holes receives the retraction pins of side bar 26.

Figure 5:
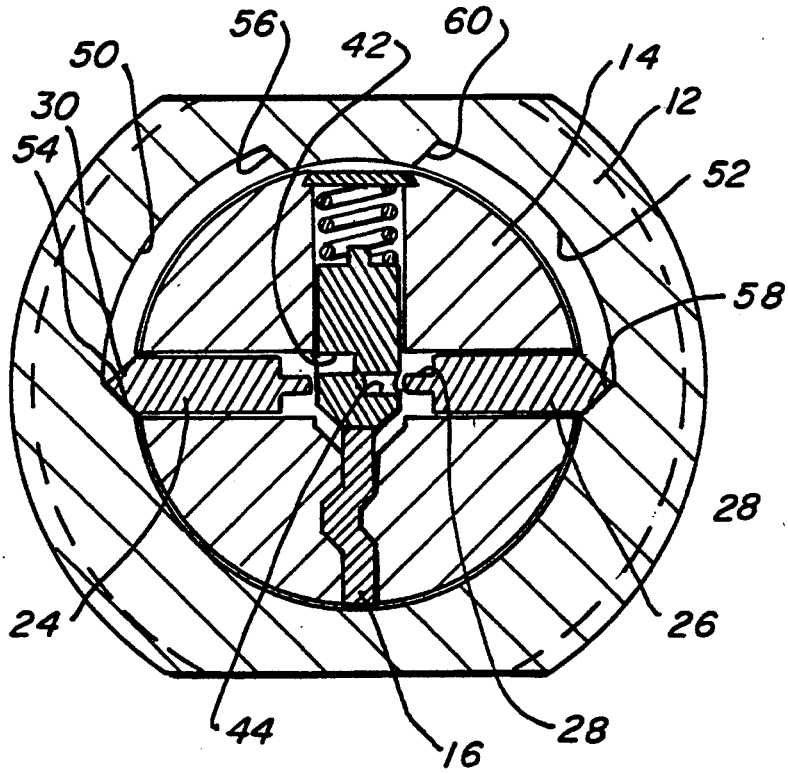
FIG. 5 is a cross sectional view taken along lines 5—5 of FIG. 1.
Figure 6:
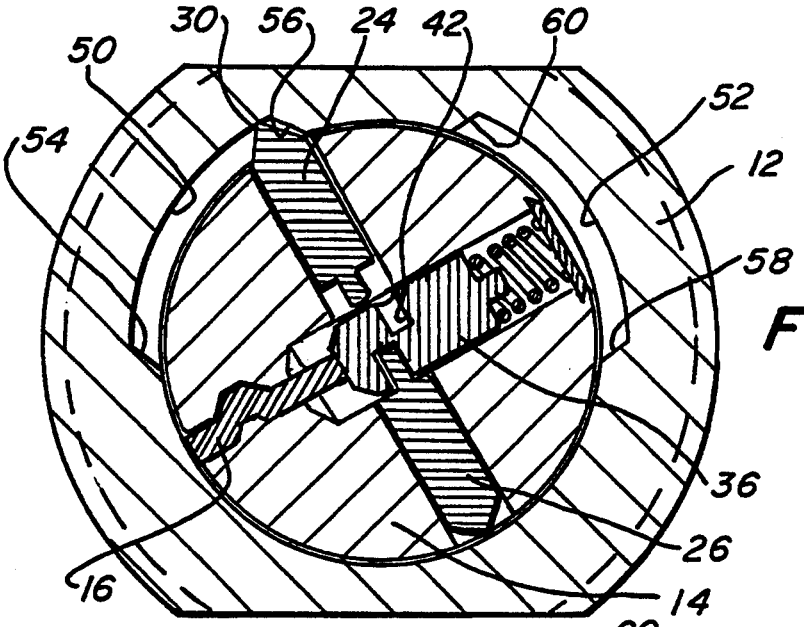
FIG. 6 is a cross sectional view similar to FIG. 5 showing, however, the core lock assembly after the core has been rotated to its first operational position.
Figure 7:
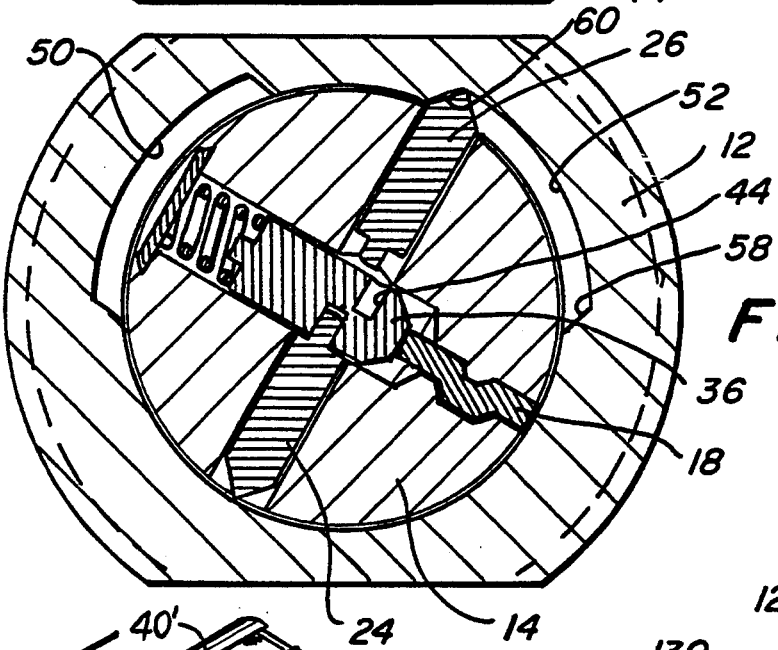
FIG. 7 is a cross sectional view similar to FIG. 5 showing, however, the core lock assembly rotated in a counterclockwise direction to its second operational direction.

FIG. 5 illustrates core 14 engaged by key 16 which aligns the set 44 of holes with the retraction pins of side bar 26. In FIG. 6, it can be seen that the core has been rotated to its first operational position by turning key 16 which, as illustrated, causes the retraction pins of side bar 26 to retract into the set 44 of holes. FIG. 7 illustrates core 14 after being engaged by second key 18 and turned to the lock's second operational position. In this position, it can be seen that the retraction pins of the first side bar 24 have retracted into the first set 42 of holes.

Those skilled in the relevant art will appreciate that rotation of core 14 is not only made possible by making the side bars retractable, but also by providing shell 12 with two relief areas 50 and 52 (best illustrated in FIGS. 3, 6 and 7) one of which receives an end 30 of an unretractable extended side bar as the core is rotated by turning key 16 or 18. In comparing FIGS. 5 and 6, it will be appreciated that while side bar 26 retracts into the core when the core is rotated in a clockwise direction, side bar 24 remains unretracted and in fact is unretractable since its retraction pins 28 are not aligned with the first set 42 of holes. The same is true for side bar 26 when the core is rotated by key 18 (see FIG. 7). Those skilled in the art will also appreciate that relief areas 50 and 52 define the degree to which core 14 is capable of rotating in the clockwise and counterclockwise directions since the relief areas' side walls 54, 56, 58 and 60 stop rotation of the core when an unretractable end 30 of a side bar makes contact with a side wall.

As previously mentioned, FIG. 3 illustrates core lock 10 in its locked state which is the state the lock is in when it is not engaged by key 16 or 18. In this position, it can be seen that neither side bar 24 nor 26 can retract into the core since neither set 42 nor set 44 of the pin tumbler's holes is aligned with the retraction pins of the side bars. As such, the core is prevented from rotating since the unretractable end of side bar 24 abuts side wall 54 to prevent counterclockwise rotation of the core while the unretractable end of side bar 26 abuts side wall 58, to prevent clockwise rotation of the core.

When core 14 is rotated to the first operational position illustrated in FIG. 6, switch 11 may be activated as is known in the art to perform any one of a number of functions. For example, a door locked by lock 10 may be unlocked or an electrical circuit controlled by lock 10 may be turned on, etc. Switch 11 may also be activated to perform another function when the core is rotated to the second operational position illustrated in FIG. 7. Or, if the lock is provided with the core removal means illustrated in FIGS. 13 through 16 below, core 14 may be removed from the shell.

Figure 8:
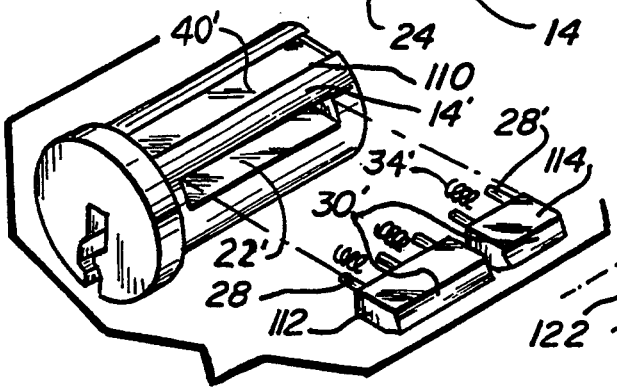
FIG. 8 is a perspective view of the core of another core lock assembly of the present invention.
Figure 9:
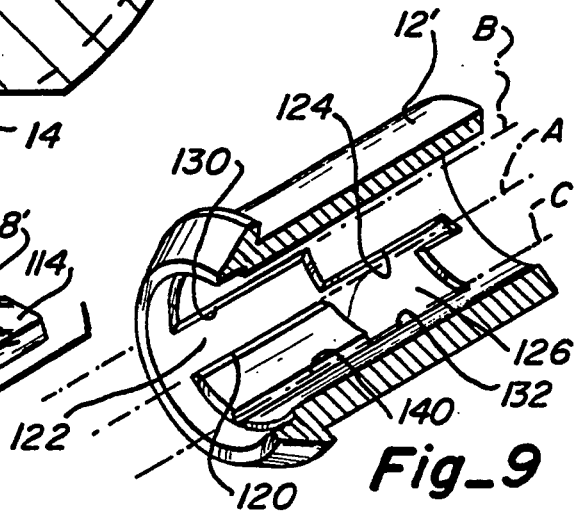
FIG. 9 is a partially broken away perspective view of the shell for the core illustrated in FIG. 8.

FIGS. 8 and 9 illustrate a second embodiment of the present invention, i.e. a core lock assembly 110 having laterally arranged side bars 112 and 114 disposed in end-to-end relation to one another and aligned for insertion in a common side bar slot 22'. The side bars 112 and 114 differ from those illustrated in FIGS. 1 through 7 wherein the side bars are located on opposite side bar slots 20 and 22 of the core. While somewhat different structurally, core lock assembly 110 functions very similarly to core lock 10. Accordingly, the components of lock 110 which are similar to those of core lock 10 are identified by the same numeral with the exception that the numerals are primed.

As can be visualized from FIG. 9, core 14' of lock 110 is located in a locked position when the core is turned to a position where side bars 112 and 114 are axially aligned with the dotted line identified by the letter "A". In this position, it will be appreciated that end 30' of unretractable side bar 112 abuts against a side wall 120 of a first relief area identified by numeral 122. End 30' of side bar 114 which is also in an unretractable extended position abuts against a side wall 124 of the second relief area which is identified by numeral 126. Since both side bars remain unretractable until the core is engaged by a properly bitted key, side walls 120 and 124 of the respective relief areas prevent the core from rotating, much in the manner that side walls 54 and 58 of the relief areas of core lock 10 prevent core 14 from rotating.

To rotate core 14' clockwise to the first operational position which is the position the core would be in when side bars 112, 114 are axially aligned with the dotted line identified by the letter "B", one inserts a first key (not shown) which is properly bitted so that the two retraction pins 28' of side bar 114 cooperate with the lock's pin tumblers (not shown) to enable the side bar 114 to retract into the core. One then simply turns the key clockwise until the core is in the first operational position. Side wall 130 of the first relief area 122 prevents further clockwise rotation of the core when the first operational position is reached since end 30' of side bar 112 (which cannot retract) bears against side wall 130. Similarly, to rotate the core from the locked position to the second operational position identified by the letter "C", one inserts a different but properly bitted key (i.e. a second key, not shown) into the core to enable the three pins 28 of side bar 112 to cooperate with the lock's pin tumblers (not shown) so that side bar 112 can retract into the core. One then turns the key counterclockwise until the core is in its second operational position. Side wall 132 of second relief area 126 prevents further counterclockwise rotation of the core when the second operational position is reached since end 30' of side bar 114 (which cannot retract) bears against side wall 132.

It will also be appreciated that shell 12' defines a groove 140 which is aligned with side wall 132 of the second relief area and which extends out to the front of the shell. Groove 140 enables one to remove the second key from the core when the core is in the second operational position C since side bar 112, i.e. its end 30' fully extends into groove 140 when the core is rotated to position C. (This is because springs 34' bias the side bar 112 to its extended position.) Since fully extended in groove 140, retraction pins 28 of the side bar 112 are disengaged from the pin tumblers 36, i.e. not located in the pin tumblers holes (not shown). Accordingly, the pin tumblers are free to move upwardly and downwardly which thereby permits one to remove the key from the core. Thus, groove 140 enables one to lock core lock 110 in its second operational position which could be, for example, an electrically "on" position if core lock 110 were a "switch lock". This would enable one to lock an electrical device or circuit in an on position, thereby preventing one from being able to turn the device off or at least making it more difficult to do so.

Returning to FIG. 9, those skilled in the art will appreciate that position C can also serve as a "locked off" position. If used in this manner, position A (illustrated in FIG. 9) would be the lock's first operational position while position B would be the lock's second operational position. This manner of using core lock 110 differs from those previously described in that only one key, not both keys, can be used in the "locked off" position to rotate the core, i.e. the previously described first key will not work when the core is in position C. Only the second key works from position C. Similarly, only the first key works from position A to rotate the core to position B. Of course, to insert the first key into the core when the core is in position A, the second key which was used to rotate the core from "locked off" position C to position A must be removed. Thus, it will be appreciated that lock 110 has a second locked position even when used in this manner. It will also be appreciated that position A can serve as a "locked on" position. In summation, it can be seen that the provision of groove 140 provides lock 110 with two locked positions either of which may serve as "locked on" or "locked off" positions.

It will also be appreciated that if core lock 110 is provided with core removal means such as that illustrated in FIGS. 13–16 below, end 30' of side bar 114 will slide through groove 140 to permit the core to be removed from the shell when the core is in position C.

Those skilled in the art will also appreciate that the particular embodiment of FIGS. 8 and 9 could also be operated by a third key which might, for example, cooperate with all of the core's pin tumblers (not shown) to enable both side bars 112 and 114 to retract into the core. This would enable the core to be rotated a full 360° or to some third position which might also enable the core to be removed or, if desired, it might activate a switch such as switch 11 of core lock 10 to perform some other function.

Figure 10:
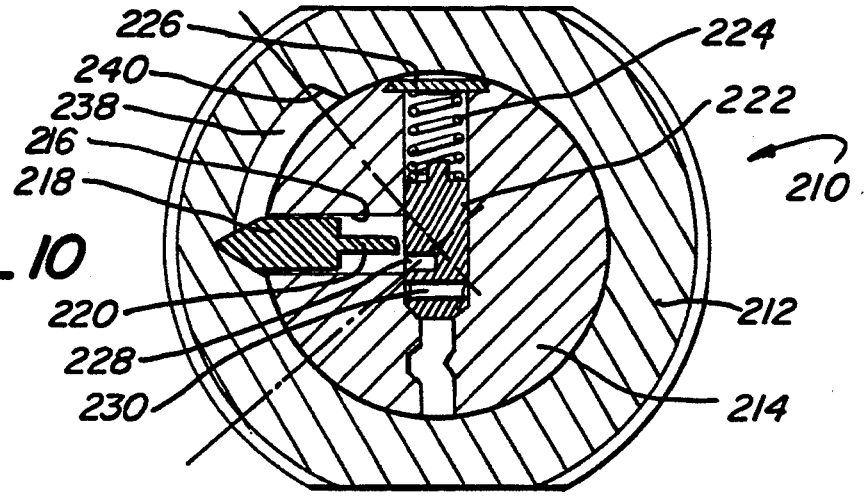
FIG. 10 is a cross sectional view of another core lock assembly of the present invention which illustrates the core lock assembly in its locked position.
Figure 11:
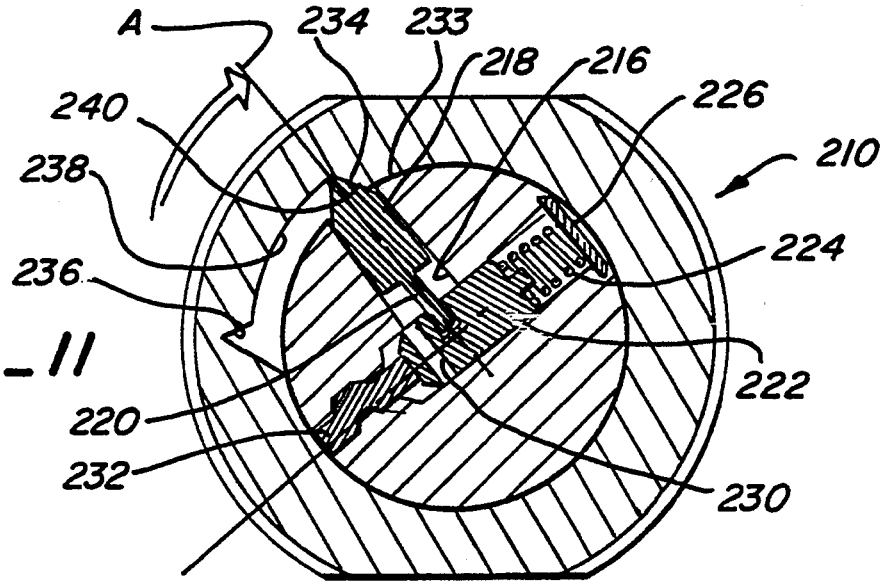
FIG. 11 is a cross sectional view of the core lock assembly illustrated in FIG. 10 showing the lock in its first operational position.
Figure 12:
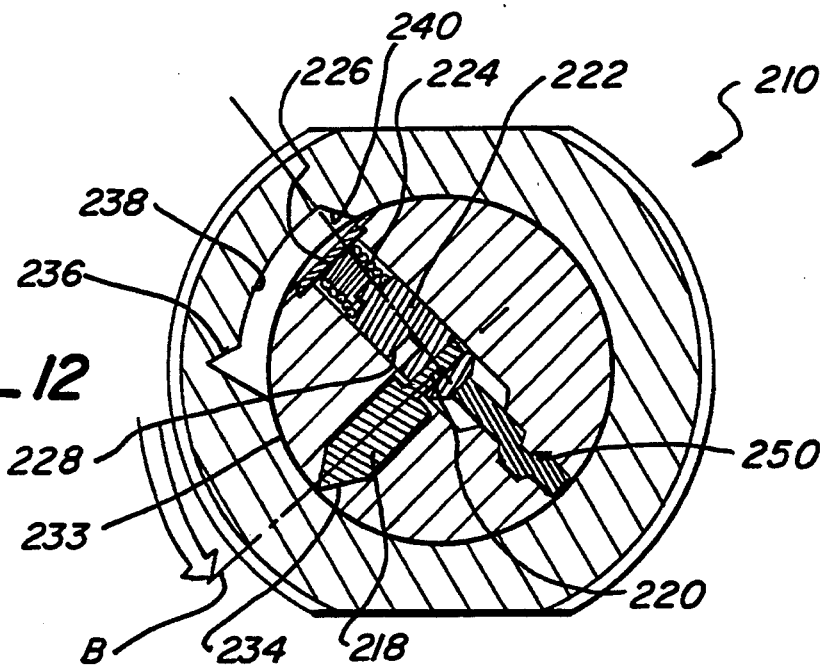
FIG. 12 is a cross sectional view of the core lock assembly of FIG. 10 showing the lock in its second operational position.

FIGS. 10, 11 and 12 illustrate a core lock assembly 210 representing a third embodiment of the present invention. As with core lock assemblies 10 and 110, core lock assembly 210 generally includes a hollow shell 212 which receives a rotatable core 214. Core 214 defines a single side bar slot 216 for receiving a single movable side bar 218. Side bar 218 is provided with a plurality such as five retraction pins 220 which are similar to pins 28 of core lock assembly 10. A plurality of pin tumblers 222 are also provided which are biased by springs 224 which in turn are retained by retainer 226 as is known in the art. Pin tumblers 222 define two sets 228 and 230 of holes for receiving retraction pins 220 of side bar 218.

Core lock assembly 210 is similar to core locks 10 and 110 in that it is also operable by two differently bitted keys. FIG. 11 illustrates the operation of core lock assembly 210 with a first key 232. As shown, key 232 cooperates with the pin tumblers so that the first set 228 of holes aligns with the retraction pins 220 to enable the side bar to retract into the core. It will be appreciated, however, that the holes of first set 228 are not deep enough to enable the pins to fully retract into the core, i.e. within the perimeter 233 of core 214. The side bar is, however, permitted to retract to a position (referred to as the first position in the claims) where its end 234 is out of engagement with a groove 236 provided in the shell which, when engaged as illustrated in FIG. 10 prevents the core from rotating, i.e. when pins 220 cannot be retracted. (FIG. 10 illustrates core lock assembly 210 in its locked "key removed" state).

Returning to FIG. 11, it can be seen that end 234 of the side bar has been moved or slid (actually rotated about the core's axis) in this partially retracted position along a relief area 238 provided in the core lock's shell 212. This movement rotated the core to its first operational position identified by the letter "A". Further rotation of the core is prevented since the side bar's end 234 (which cannot retract any further into the core) impacts up against the side wall 240 of the relief area. In this position, a switch such as switch 11 of core lock assembly 10 may be activated to perform any number of functions or some other device such as a cam may be in a position to enable some other function to be performed.

FIG. 12 illustrates the operation of core lock assembly 210 with a second differently bitted key 250. Those skilled in the relevant art will appreciate that when the core lock assembly is operated by key 250, the pin tumblers align so that the second set of holes 230 (which happen to be a deeper set of holes) align with the retraction pins 220 of the side bar. As such, side bar 218 is capable of fully retracting into the core, i.e. within the core's perimeter 233. Moreover, since there is only one side bar, core 214 can, if desired and if not inhibited by some other means, rotate a full 360°. In FIG. 12 it can be seen the core has been rotated to a position referred to herein as the second operational position which is identified by the letter "B". To help the user find this position, a small detent or groove (not shown) could be provided in the shell. In this position, a switch such as switch 11 of core lock assembly 10 could be activated to perform yet another function or the core could be removed from the shell if it were provided with a core removal means such as that described in FIGS. 13 through 16. A groove as deep as groove 236 can also be located in the shell at this point, i.e. at the second operational position B which would enable the side bar to return to its fully extended position. This would enable one to remove the key from the core, thereby providing the lock with another locked position which could function as a "locked on" position.

While side bar 218 is shown as being fully retracted in FIG. 12, it will be appreciated that the lock could be designed so that the side bar only partially retracts in the second rotational state which could be to a depth shallower than that shown in FIG. 11. It will also be appreciated that shell 214 could be provided with a shallower relief area than relief area 238 which would receive and cooperate with the side bar in this state.

Figure 13:
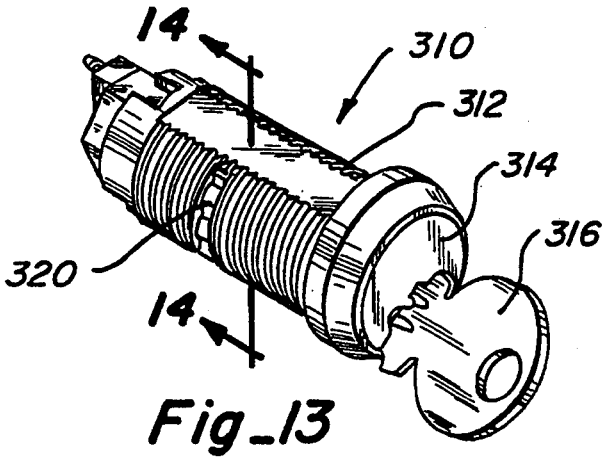
FIG. 13 is a perspective view of a core lock assembly which is provided with the core removal means of the present invention.
Figure 14:
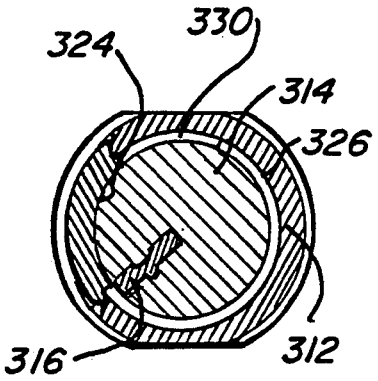
FIG. 14 is a cross sectional view taken along lines 14—14 of FIG. 13.
Figure 15:
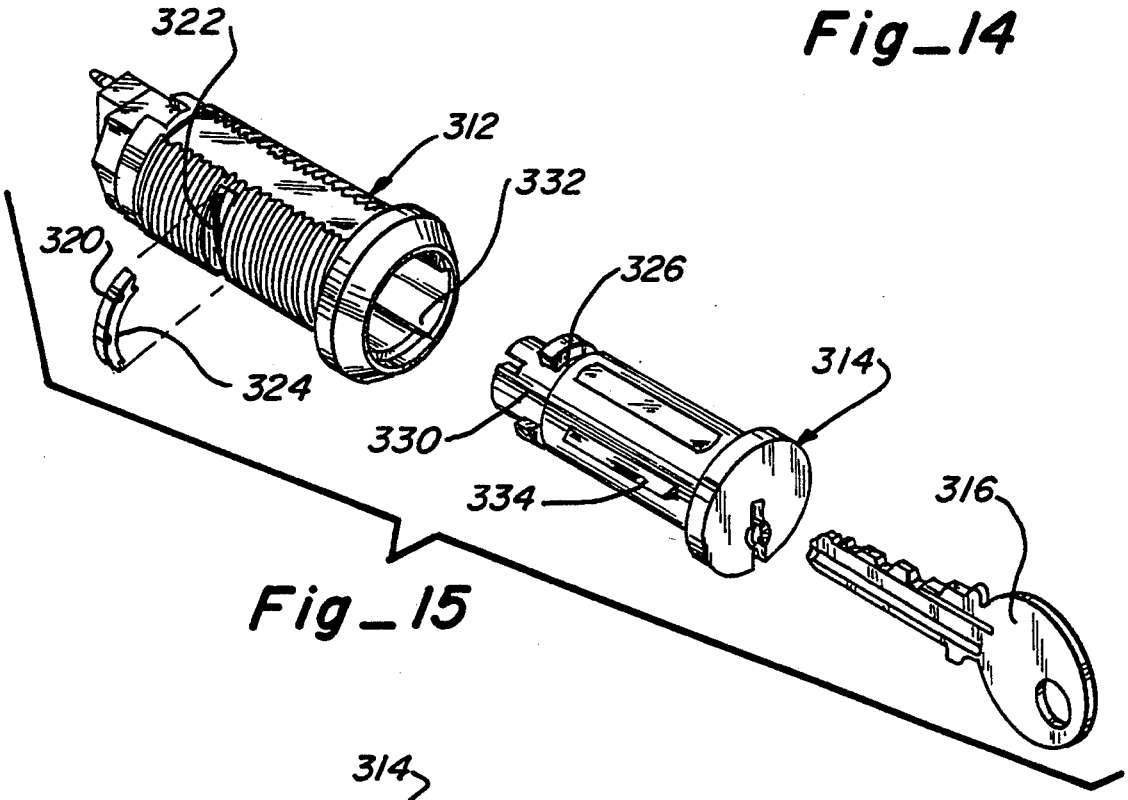
FIG. 15 is an exploded perspective view of the core lock assembly illustrated in FIG. 13 which illustrates the core after it has been rotated to an operational position that would enable one to remove the core from the shell.
Figure 16:
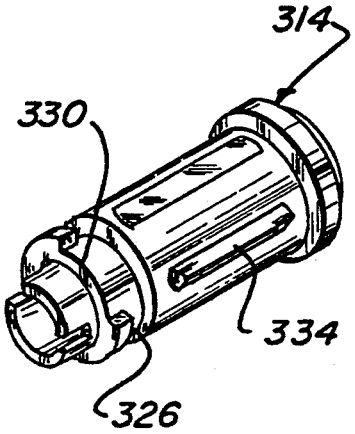
FIG. 16 is a perspective view of the core of the core lock assembly of FIGS. 13–15.

FIGS. 13 through 16 illustrate a core lock 310 having a core removal means of the present invention which is operable with any of the previously illustrated embodiments, i.e. core locks 10, 110 and 210. As with the other core locks, core lock assembly 310 has a shell 312 and a rotatable core 314. FIGS. 13 and 14 illustrate core lock assembly 310 in its locked position, although in FIG. 13 lock 310 is not in its locked state since a key 316 is located in the key hole of core 314. FIG. 15 illustrates core lock 310 after core 314 has been rotated counter clockwise to a position which enables the core to be removed.

As shown in FIG. 15, the core removal means (not numbered) includes a retainer means or clip 320 which is received in a slot 322 extending through shell 312. The retainer clip is dimensioned so that it has an inwardly facing projection 324 which projects inwardly into the hollow portion of the shell as is best illustrated in FIG. 14. The core removal means further includes a groove 326 provided in the outer surface of core 314 for receiving inner facing projection 324 of the retainer clip 320. When the core lock assembly is in its locked position as illustrated in FIG. 14, the inner facing projection received in the groove prevents axial movement of the core along its longitudinal axis, thereby preventing the core from being removed from the shell. To remove the core from the shell, the core is provided with a cut-out portion 330 which extends from the bottom of groove 326 to the rear end of the core. Cut-out portion 330 is sized, configured, and located on the core to receive and permit passage of inner facing projection 324 of the retainer clip when the core is rotated in a counter clockwise direction from the position illustrated in FIG. 14 to the position illustrated in FIG. 15. After rotating the core to this position, those skilled in the art will recognize that the cut-out portion 331 and the inner facing projection 324 are arranged laterally with respect to each other. As such, the core can be removed from the shell by simply pulling the core out through the front end of the shell, i.e. moving the core axially out of the shell, which is accomplished by simply pulling on key 316 until the core is removed from the shell. The key will not slide out of the core's key hole since the lock's pin tumblers (not shown) remain in engagement with the bites of the key until the core is removed from the shell.

The core removal means further includes providing the shell with a groove or relief area such as relief area 332 which extends to the front of the shell as illustrated in FIG. 15. The groove or relief area would typically be an extension of a groove or relief area provided in the shell such as groove 140 of core lock 110 which extends from relief area 126 to the front end of the lock as such is illustrated in FIG. 9. The extended grooves and/or relief areas provide a path for the end of any partially retracted or extended side bar (such as end 334 of the side bar illustrated in FIG. 16) in which the end travels as the core is removed from the shell. A fully retracted side bar such as side bar 218 of core lock assembly 210 quite obviously does not need an extended groove or relief area since it is fully retracted within the core's perimeter.

The invention is described in detail with reference to particular embodiments thereof, but it will be understood that various other modifications could be effected within the spirit and scope of this invention. For example, while each embodiment described herein utilizes side bars for engaging the shells of the various core lock assemblies, other means for engaging the shell could also be employed such as wafers or disc tumblers similar to those used in the Model No. MFW 3038cylinder lock which is manufactured by the Fort Lock Company of River Grove, Ill. All of the embodiments described herein also utilize pin tumblers for key engagement. However, it is to be understood that other means for engaging a key include disc tumblers such as those used in the ignition switches of automobiles manufactured by the General Motors Corporation of Detroit, Mich. and those used in cylinder locks manufactured by Abloy Inc. of Joensuu, Finland. Electronic and/or magnetic means for recognizing the presence of a properly bitted key may be used for key engagement as well.

It is also within the scope of the present invention to design a core lock utilizing features of all three embodiments disclosed herein. For example, it would be possible to design a lock having "two" sets of split or laterally arranged side bars similar to those illustrated in the second embodiment of FIGS. 8 and 9. This could be done by locating one set of split or laterally arranged side bars on one side of the core lock while the other set is located on the opposite side of the lock. In addition, the pin tumblers holes of such a core lock could be drilled to different depths which would enable the side bars to partially retract to different depths, i.e. similar to the manner in which the side bar partially retracts as illustrated in the third embodiment of FIGS. 10 through 12 (see FIG. 11 in particular). The shell of such a core lock could also be provided with multiple relief areas of varying depths that would cooperate with the side bars in their various states of partial retraction. All of these modifications are clearly within the spirit and scope of the present invention. Moreover, it is clear that other modifications can also be effected within the spirit and scope of this invention.

What is claimed:

1. In a core lock assembly wherein a shell has an inner surface defining a hollow portion, and a core having a keyway and tumbler elements disposed in said core in the path of movement of a key inserted into said keyway, said core being rotatable in said hollow portion from a locked position to a first operational position under the control of a first key and for rotation from said locked position to a second operational position under the control of a second differently bitted key, said core being elongated and having a longitudinal axis extending centrally thereof, the improvement comprising: a plurality of elongated side bars, said side bars elongated in a direction parallel to the axis of said core and inserted in end-to-end relation to one another into a common elongated radial slot in said core, said side bars being independently movable between an extended position beyond the perimeter of said core and a retracted position substantially within the perimeter of said core; and said inner surface of said shell including first and second surface means, each of said first and second surface means cooperating with a different one of said side bars in permitting said core to be rotated to a selected one of said first and second operational positions by turning one of said first and second keys in said keyway.

2. In a core lock assembly as claimed in claim 1 wherein said core has a single locked position for key insertion and removal.

3. In a core lock assembly as claimed in claim 1 wherein said core has a plurality of locked positions for key insertion and removal.

4. A core lock assembly as claimed in claim 1 wherein said core has a plurality of locked positions for key insertion and removal at least one of which is one of said core's operational positions.

5. A core lock assembly as claimed in claim 1 wherein said first and second surface means are surface areas defined by said inner surface of said shell.

6. In a core lock assembly as claimed in claim 1 wherein:

said first and second side bars have retraction pins and wherein said tumbler elements include a first set of holes for receiving said retraction pins of said first side bar to enable said first side bar to retract into said slot so that said core can be rotated to the first operational position by turning the first key, and said tumbler elements include a second set of holes for receiving said retraction pins of said second side bar to enable said second side bar to retract into said slot so that said core can be rotated to the second operational position by turning the second key;

each of said side bars include first and second portions which move between said extended and retracted positions, said first portion being in said extended position when an outer end of said first portion extends beyond the perimeter of said core, said second portion being in said retracted position when its inner end is located within the core's perimeter, said first portion being movable to a retracted position when said tumbler elements are engaged by the first key which enables said core to be rotated from the locked position to the first operational position, said second portion being movable to said retracted position when said tumbler elements are engaged by the second key which enables said core to be rotated from the locked position to the second operational position;

said first surface means defining a first relief area to receive and permit rotational movement of said outer end of said first portion of said first side bar so that said core can be rotated to the first operational position by turning the first key;

said second surface means defining a second relief area to receive and permit rotational movement of said outer end of said first portion of said second side bar so that said core can be rotated to the second operational position by turning the second key;

said first and second surface means being defined by sidewalls of said first and second relief areas which are located to prevent rotational movement of said outer ends of said first and second portions when said outer ends are in their extended positions and said core is in said locked position.

7. In a core lock assembly as claimed in claim 6 wherein said first and second side bars are aligned with said longitudinal axis of said core.

8. In a core lock assembly as claimed in claim 6 wherein said first and second side bars are spring loaded so that said side bars are biased towards their extended positions.

9. In a core lock assembly as claimed in claim 1 further comprising core removal means for enabling said core to be removed from said shell when said core is rotated to one of said first and second operational positions.

10. In a core lock assembly as claimed in claim 9 wherein said core removal means includes:

a slot provided in said shell, said shell having a rear end and a front end wherein said front end defines the entrance of said hollow portion of said shell through which said core passes when it is inserted into and removed from said shell;

said core removal means further including retainer means received in said slot, said retainer means having an inner facing projection which projects inwardly into said hollow portion of said shell;

said core removal means further including a groove provided in the outer surface of said core for receiving said inner facing projection of said retainer means to prevent axial movement of said core within said shell along the longitudinal axis of said shell and core;

said core removal means further including a cut-out portion of said core which extends from the bottom of said groove to a rear end of said core, said cut-out portion being located to receive and permit passage of said inner facing projection of said retainer means when said core is rotated to one of the first or second operational positions and pulled axially to remove said core from said shell.

11. In a core lock assembly as claimed in claim 1 wherein said core lock assembly is of the switch lock type.

12. In a core lock assembly as claimed in claim 1 wherein said core lock assembly is of the cam lock type.

13. In a core lock assembly as claimed in claim 1 which is operable by three differently bitted keys.

14. In a core lock assembly as claimed in claim 1, wherein said first and second surface means are defined by relief areas generally located on the same side of said shell.

15. In a core lock assembly as claimed in claim 1 wherein each of said first and second surface means defines a groove for receiving an outer end of each said side bar in its extended position to enable a key engaging said tumbler elements to be removed from said core, the removal of which returns said core to its locked position, said first surface means defining a first area on said inner surface of said shell which is located to cooperate with said outer end of said first side bar in a partially retracted position to permit rotational movement of said first one side bar so that said core can be rotated to the first operational position by turning the first key, said second surface means defining a second area on said inner surface of said shell which cooperates with said outer end of said second side bar in a partially retracted position to permit rotational movement of said second side bar so that said core can be rotated to the second operational position by turning the second key.

16. In a core lock assembly as claimed in claim 1 wherein:

each of said side bars having retraction pins which enable said side bars to retract into said core from an extended position to a partially retracted first position and a fully retracted second position, said side bars being in the extended or partially retracted position when outer portions of said side bars extend beyond the perimeter of said core, said side bars being in fully retracted positions when substantially all of said side bars are located within said core's perimeter;

said tumbler elements including a plurality of pin tumblers located within said core, said pin tumblers being operable by first and second differently bitted keys, said pin tumblers defining a first set of holes of predetermined depth for receiving said retraction pins of said first side bar to enable said first side bar to partially retract into said core from the extended position to said partially retracted position so that said core can be rotated to the first operational position by turning the first key, said pin tumblers also defining a second set of holes having a predetermined depth which is greater than that of the first set of holes for receiving said retraction pins of said second side bar to enable said second side bar to fully retract into said core from the extended position to said fully retracted position so that said core can be rotated to the second operational position by turning the second key; and wherein said first surface means defines a groove for receiving said outer portion of said first side bar in its extended position to enable a key engaging said core to be removed from said core, the removal of which returns said core to its locked position, said first surface means defining a single relief area which is located to cooperate with said first side bar in its partially retracted position to permit limited rotational movement of said first side bar so that said core can be rotated to the first operational position by turning the first key, said second surface means defining substantially the remainder of said inner surface of said shell which cooperates with said second side bar in its fully retracted position to permit rotational movement of said second side bar so that said core can be rotated to the second operational position by turning the second key.

17. In a core assembly wherein a generally cylindrical shell has an inner surface defining a hollow portion, and an elongated core is inserted into said hollow portion, said elongated core having a keyway, a longitudinal axis extending centrally of said core and a radially extending side bar slot, the improvement comprising:

elongated first and second side bars disposed in end-to-end relation to one another within said side bar slot, said side bars having retraction pins which enable said side bars to move radially between extended and retracted positions, each of said side bars being in an extended position when an outer portion of said side bar extends beyond the perimeter of said core and in a retracted position when substantially all of said side bar is located within the perimeter of said core;

a plurality of pin tumblers located within said core, said pin tumblers being operable by at least first and second differently bitted keys, said pin tumblers defining a first set of holes for receiving said retraction pins of said first side bar to enable said first side bar to retract into said core so that said core can be turned to a first operational position by turning the first key, said pin tumblers also defining a second set of holes for receiving said retraction pins of said second side bar to enable said second side bar to retract into said core so that said core can be turned to a second operational position by turning the second key;

said inner surface of said shell also defining at least first and second relief areas for respectively receiving said outer portions of said first and second side bars in their extended positions, said first relief area permitting limited movement of said outer portion of said extended first side bar to enable said core to be rotated to the second operational position by turning the second key, said second relief area permitting limited movement of said outer portion of said second extended side bar to enable said core to be rotated to the first operational position by turning the first key.

* * * * *